US010378812B2

(12) United States Patent
Kim et al.

(10) Patent No.: US 10,378,812 B2
(45) Date of Patent: Aug. 13, 2019

(54) REFRIGERATOR INCLUDING QUICK-CHILLING CHAMBER

(71) Applicant: Samsung Electronics Co., Ltd., Suwon-si, Gyeonggi-do (KR)

(72) Inventors: Jin Wook Kim, Gimcheon-si (KR); Jae Hyung Kim, Gwangju-si (KR); Gi Ha Woo, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/849,011

(22) Filed: Dec. 20, 2017

(65) Prior Publication Data

US 2018/0172332 A1 Jun. 21, 2018

(30) Foreign Application Priority Data

Dec. 21, 2016 (KR) ..... 10-2016-0176019

(51) Int. Cl.

| | |
|---|---|
| ***F25D 17/06*** | (2006.01) |
| ***F25D 23/06*** | (2006.01) |
| ***F25D 13/04*** | (2006.01) |
| ***F25D 11/02*** | (2006.01) |

(52) U.S. Cl.

CPC ..... *F25D 17/065* (2013.01); *F25D 13/04* (2013.01); *F25D 23/062* (2013.01); *F25D 23/068* (2013.01); *F25D 11/02* (2013.01); *F25D 2317/061* (2013.01); *F25D 2323/023* (2013.01); *F25D 2400/28* (2013.01)

(58) Field of Classification Search

CPC .. F25D 17/065; F25D 23/062; F25D 2400/28; F25D 2323/023; F25D 2317/061; F25D 13/04; F25D 23/068; F25D 11/02

See application file for complete search history.

(56) References Cited

U.S. PATENT DOCUMENTS 4,358,932 A * 11/1982 Helfrich, Jr. ..... F25D 17/062 62/126
4,368,622 A * 1/1983 Brooks ..... F25D 17/062 62/157
4,586,347 A * 5/1986 McCarty ..... F25D 17/065 62/265
5,896,753 A * 4/1999 Kwak ..... F25B 5/00 62/324.3

(Continued)

FOREIGN PATENT DOCUMENTS

JP 01271697 A * 10/1989
JP 2002295953 A * 10/2002
WO 2014-132253 A1 9/2014

OTHER PUBLICATIONS

European Search Report dated May 14, 2018, issued in European Patent Application No. 17209065.6.

*Primary Examiner* — Kun Kai Ma
(74) *Attorney, Agent, or Firm* — Jefferson IP Law, LLP

(57) ABSTRACT

A refrigerator is provided. The refrigerator includes a freezing compartment, a refrigerating compartment, a quick-chilling chamber, and a compressor that supplies cold air to at least one of the freezing compartment, the refrigerating compartment, or the quick-chilling chamber. The quick-chilling chamber is cooled by first cold air introduced through the compressor or second cold air introduced through the freezing compartment.

17 Claims, 10 Drawing Sheets

(56) References Cited

U.S. PATENT DOCUMENTS

| | | | | |
|---|---|---|---|---|
| 6,343,477 | B1 * | 2/2002 | Mandel | F25D 17/042 62/186 |
| 6,463,752 | B2 * | 10/2002 | Mandel | F25D 17/042 62/382 |
| 7,254,958 | B2 | 8/2007 | Kim et al. | |
| 7,685,837 | B2 * | 3/2010 | Ritchie | F25D 17/065 62/408 |
| 8,341,974 | B2 * | 1/2013 | Oh | F25D 17/065 62/186 |
| 8,904,817 | B2 * | 12/2014 | Kim | F25D 17/065 62/419 |
| 9,739,272 | B2 | 8/2017 | Dobbins et al. | |
| 2003/0115892 | A1 * | 6/2003 | Fu | F25D 17/042 62/187 |
| 2006/0150661 | A1 | 7/2006 | Kim et al. | |
| 2007/0163289 | A1 * | 7/2007 | Hahm | F25D 17/045 62/408 |
| 2010/0126200 | A1 * | 5/2010 | Oh | F25D 17/065 62/335 |
| 2010/0192617 | A1 * | 8/2010 | Chae | F25D 17/065 62/419 |
| 2011/0016910 | A1 * | 1/2011 | Bak | F25D 29/00 62/449 |
| 2011/0041538 | A1 * | 2/2011 | Yoon | F25D 17/065 62/275 |
| 2014/0144928 | A1 | 5/2014 | Dobbins et al. | |
| 2014/0216084 | A1 * | 8/2014 | Ren | F25D 11/04 62/186 |
| 2016/0010912 | A1 | 1/2016 | Ashtamkar | |
| 2017/0350381 | A1 | 12/2017 | Dobbins et al. | |
| 2018/0112906 | A1 * | 4/2018 | Yl | F25D 23/02 |
| 2018/0120015 | A1 * | 5/2018 | Darka | F25D 17/04 |

* cited by examiner

REFRIGERATOR INCLUDING QUICK-CHILLING CHAMBER

CROSS-REFERENCE TO RELATED APPLICATION(S)

This application claims the benefit under 35 U.S.C. § 119(a) of a Korean patent application filed on Dec. 21, 2016 in the Korean Intellectual Property Office and assigned Serial number 10-2016-0176019, the entire disclosure of which is hereby incorporated by reference.

TECHNICAL FIELD

The present disclosure relates to a refrigerator.

BACKGROUND

A refrigerator is a device used to keep stored food or drink at a low temperature. The refrigerator may include various types of members constituting a cooling circulation system. The cooling circulation system may operate in such a manner that coolant exchanges heat with ambient air while being converted from liquid to gas, or vice versa.

The above information is presented as background information only to assist with an understanding of the present disclosure. No determination has been made, and no assertion is made, as to whether any of the above might be applicable as prior art with regard to the present disclosure.

SUMMARY

A refrigerator in the related art may include a quick-chilling chamber (or quick-chilling space). The quick-chilling chamber may be implemented with separate space of a drawer type (e.g., a chiller drawer) that is distinguished from a freezing compartment or a refrigerating compartment, or may be implemented with part of the refrigerating compartment (e.g., a chilling zone or a chilling tray) that is divided from the refrigerating compartment to isolate cold air.

The method of implementing the quick-chilling chamber with separate space has a problem in that the structure of the refrigerator is complex and manufacturing cost increases, and the method of using part of the refrigerating compartment as the quick-chilling chamber has a problem in that cooling speed decreases and stored food or drink does not uniformly chill.

Aspects of the present disclosure are to address at least the above-mentioned problems and/or disadvantages and to provide at least the advantages described below. Accordingly, an aspect of the present disclosure is to provide a refrigerator.

In accordance with an aspect of the present disclosure, a refrigerator is provided. The refrigerator includes a freezing compartment, a refrigerating compartment, a quick-chilling chamber, and a compressor that supplies cold air to at least one of the freezing compartment, the refrigerating compartment, or the quick-chilling chamber. The quick-chilling chamber is cooled by first cold air introduced through the compressor or second cold air introduced through the freezing compartment.

The refrigerator according to various embodiments of the present disclosure may implement the quick-chilling chamber by using a door of the freezing compartment, thereby enhancing space efficiency.

The refrigerator according to various embodiments of the present disclosure may allow direct cold air supplied from the compressor or indirect cold air supplied through the freezing compartment to flow into the quick-chilling chamber, thereby rapidly chilling stored objects.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
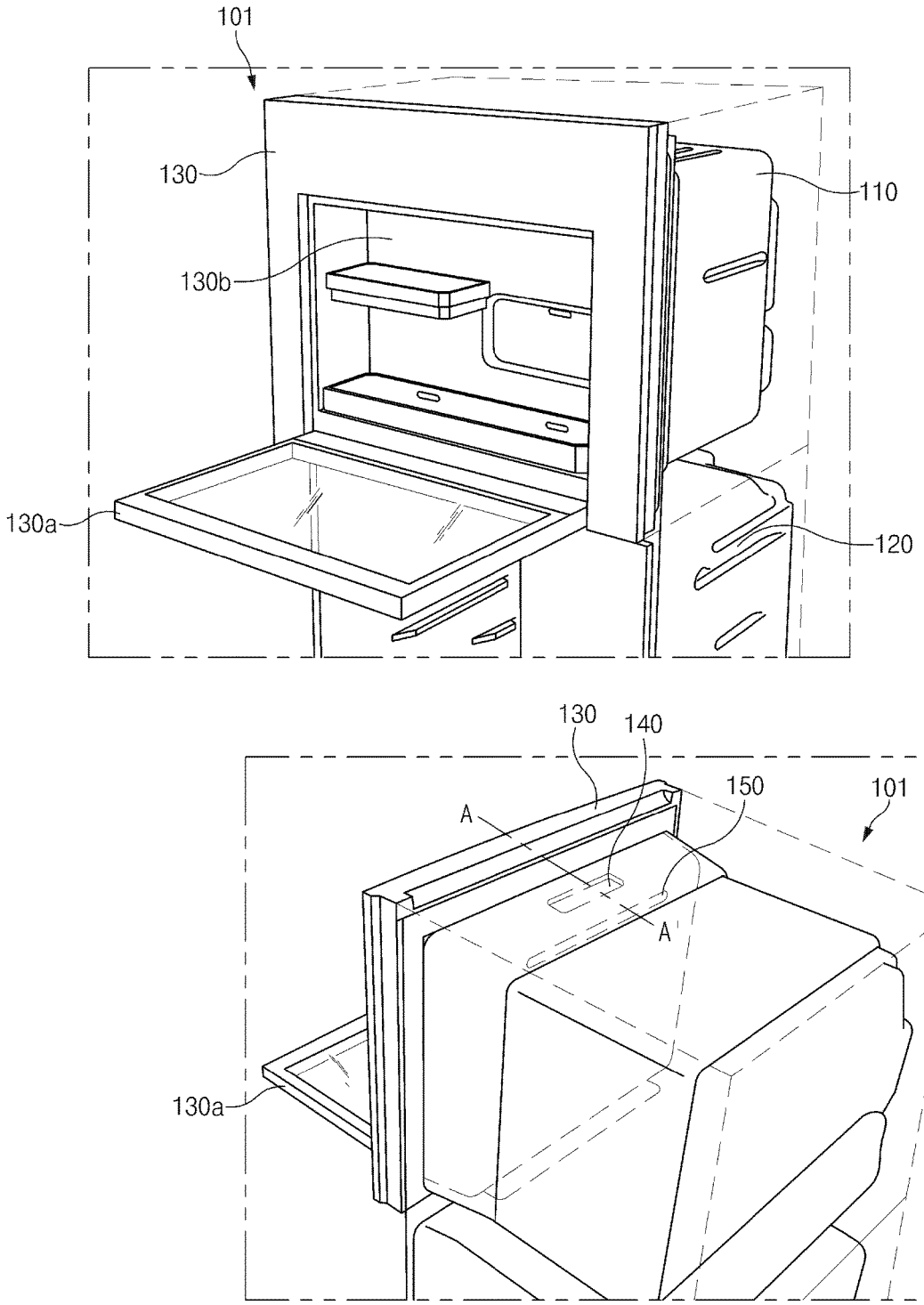
FIG. 1 illustrates a refrigerator according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modification of the various embodiments described herein can be variously made without departing from the scope and spirit of the present disclosure. In addition, description of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the disclosure disclosed herein, the expressions "have", "may have", "include" and "comprise", or "may include" and "may comprise" used herein indicate existence of corresponding features (for example, elements such as numeric values, functions, operations, or components) but do not exclude presence of additional features.

In the disclosure disclosed herein, the expressions "A or B", "at least one of A or/and B", or "one or more of A or/and B", and the like used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used herein may refer to various elements of various embodiments of the present disclosure, but do not limit the elements. For example, such terms are used only to distinguish an element from another element and do not limit the order and/or priority of the elements. For example, a first user device and a second user device may represent different user devices irrespective of sequence or importance. For example, without departing the scope of the present disclosure, a first element may be referred to as a second element, and similarly, a second element may be referred to as a first element.

It will be understood that when an element (for example, a first element) is referred to as being "(operatively or communicatively) coupled with/to" or "connected to" another element (for example, a second element), it can be directly coupled with/to or connected to the other element or an intervening element (for example, a third element) may be present. In contrast, when an element (for example, a first element) is referred to as being "directly coupled with/to" or "directly connected to" another element (for example, a second element), it should be understood that there is no intervening element (for example, a third element).

According to the situation, the expression "configured to" used herein may be used as, for example, the expression "suitable for", "having the capacity to", "designed to", "adapted to", "made to", or "capable of". The term "configured to (or set to)" must not mean only "specifically designed to" in hardware. Instead, the expression "a device configured to" may mean that the device is "capable of" operating together with another device or other components. central processing unit (CPU), for example, a "processor configured to (or set to) perform A, B, and C" may mean a dedicated processor (for example, an embedded processor) for performing a corresponding operation or a generic-purpose processor (for example, a CPU or an application processor) which may perform corresponding operations by executing one or more software programs which are stored in a memory device.

Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even if terms are terms which are defined in the specification, they may not be interpreted to exclude embodiments of the present disclosure.

FIG. 1 illustrates a refrigerator according to various embodiments of the present disclosure.

Referring to FIG. 1, a refrigerator 101 may lower the temperature inside to keep stored food or drink cold. The refrigerator 101 may include a freezing compartment 110 and a refrigerating compartment 120. The freezing compartment 110 may maintain the inside thereof at a specified temperature (e.g., −10 degrees Celsius) lower than or equal to 0 degrees Celsius to store food or drink in a frozen state. The refrigerating compartment 120 may maintain the inside thereof at a specified temperature (e.g., 2 degrees Celsius) higher than or equal to 0 degrees Celsius to store food or drink in an unfrozen state. While FIG. 1 illustrates that the freezing compartment 110 is formed on an upper side of the refrigerator 101 and the refrigerating compartment 120 is formed on a lower side of the refrigerator 101, the present disclosure is not limited thereto. For example, the freezing compartment 110 may be formed on a lower side of the refrigerator 101, and the refrigerating compartment 120 may be formed on an upper side of the refrigerator 101.

According to various embodiments, a door of the freezing compartment 110 may be implemented with a quick-chilling chamber 130. In the case where a user rotates the entire quick-chilling chamber 130 from the left to the right, space inside the freezing compartment 110 may be exposed. In the case where the user rotates a door 130*a* of the quick-chilling chamber 130 downwards, an inner space 130*b* of the quick-chilling chamber 130 may be exposed. While FIG. 1 illustrates that the door of the freezing compartment 110 is opened from the left to the right and the door 130*a* of the quick-chilling chamber 130 is opened downwards, the present disclosure is not limited thereto. For example, the door of the freezing compartment 110 may be opened from the left to the right, and the door 130*a* of the quick-chilling chamber 130 may be opened from the right to the left.

The quick-chilling chamber 130 may more rapidly chill food or drink than the refrigerating compartment 120. For example, in the case where the user stores a drink of room temperature (e.g., 26 degrees Celsius to 36 degrees Celsius) in the quick-chilling chamber 130, the quick-chilling chamber 130 may more rapidly chill the drink into a chilled state (e.g., 2 degrees Celsius to 8 degrees Celsius) than the refrigerating compartment 120. The quick-chilling chamber 130 may include, in the inner space 130*b* thereof, one or more racks on which to place food or drink.

According to various embodiments, the quick-chilling chamber 130 may be cooled by direct cold air supplied from a compressor (not illustrated) in the refrigerator 101 or indirect cold air supplied through the freezing compartment 110. The direct cold air may have a lower temperature than the indirect cold air. The quick-chilling chamber 130 may primarily lower the temperature of food or drink by using the strong direct cold air and may then store the food or drink in an unfrozen state by using the indirect cold air.

According to various embodiments, the cold air may be introduced into the quick-chilling chamber 130 through a first cold-air inlet 140 or a second cold-air inlet 150. In one embodiment, the direct cold air supplied from the compressor may be introduced into the quick-chilling chamber 130 through the first cold-air inlet 140, and the indirect cold air supplied from the freezing compartment 110 may be introduced into the quick-chilling chamber 130 through the second cold-air inlet 150.

Information about a method of introducing the direct cold air or the indirect cold air into the quick-chilling chamber 130 through the first cold-air inlet 140 or the second cold-air inlet 150 may be provided through FIGS. 2 to 10.

While FIG. 1 illustrates that the quick-chilling chamber 130 is formed in the door of the freezing compartment 110, the present disclosure is not limited thereto. For example, the quick-chilling chamber 130 may be formed in a door of the refrigerating compartment 120.

While FIG. 1 illustrates that the refrigerator 101 includes both the freezing compartment 110 and the refrigerating compartment 120, the present disclosure is not limited thereto. For example, the refrigerator 101 may include only the freezing compartment 110 without the separate refrigerating compartment 120, and the quick-chilling chamber 130 may be formed in the door of the freezing compartment 110.

Figure 2:
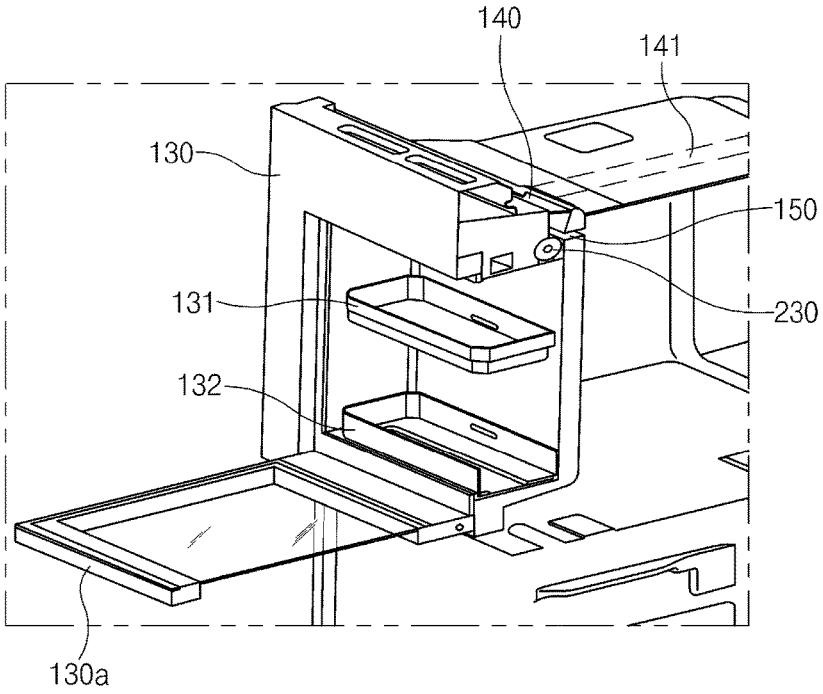
FIG. 2 is a sectional view of a quick-chilling chamber according to various embodiments of the present disclosure.
Figure 2:
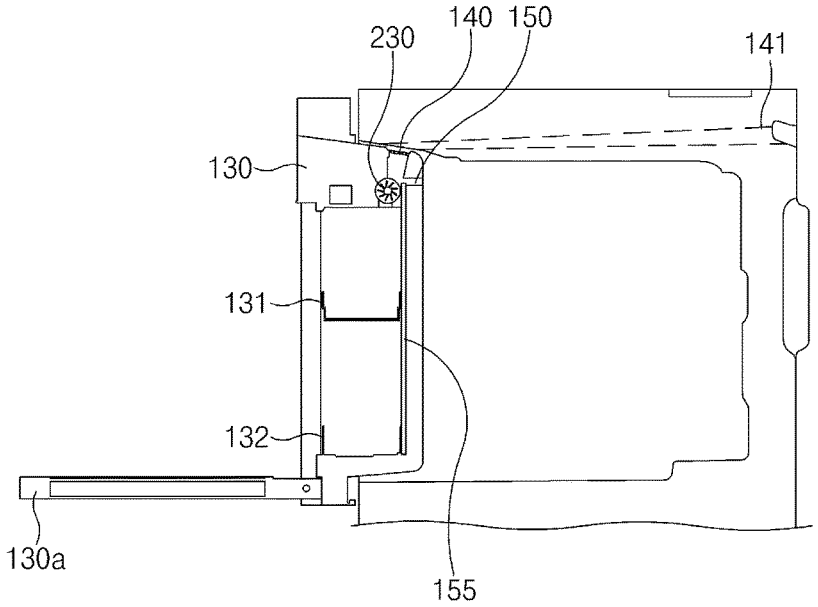

FIG. 2 is a sectional view of a quick-chilling chamber according to various embodiments of the present disclosure. FIG. 2 illustrates a sectional view taken along line A-A' of FIG. 1.

Referring to FIG. 2, cold air may be introduced into the quick-chilling chamber 130 through the first cold-air inlet 140 and the second cold-air inlet 150.

The first cold-air inlet 140 may be connected to the compressor (not illustrated) through a first flow passage 141. Direct cold air supplied from the compressor may be introduced into the quick-chilling chamber 130 through the first flow passage 141 and the first cold-air inlet 140.

The second cold-air inlet 150 may be connected to the freezing compartment 110. Part of cold air supplied to the freezing compartment 110 from the compressor (not illustrated) may be introduced into the quick-chilling chamber 130 through the second cold-air inlet 150. The indirect cold air introduced through the second cold-air inlet 150 may be delivered into the quick-chilling chamber 130 through a second flow passage 155.

The cold air introduced through the first and second cold-air inlets 140 and 150 may be directed into the quick-chilling chamber 130 by a cooling fan 230. According to various embodiments, the cooling fan 230 may be implemented in the form of twin fans, a part of which is capable of separately rotating. Additional information about the structure of the cooling fan 230 may be provided through FIG. 3.

An upper rack 131 or a lower rack 132 on which to place food or drink may be mounted on an inner wall of the quick-chilling chamber 130. The upper rack 131 may be changed into a folded state or an unfolded state. The upper rack 131 may have a relatively small beverage can placed thereon. In the case where the upper rack 131 is folded and brought into close contact with the inner wall of the quick-chilling chamber 130, the lower rack 132 may have a relatively large beverage bottle placed thereon.

Figure 3:
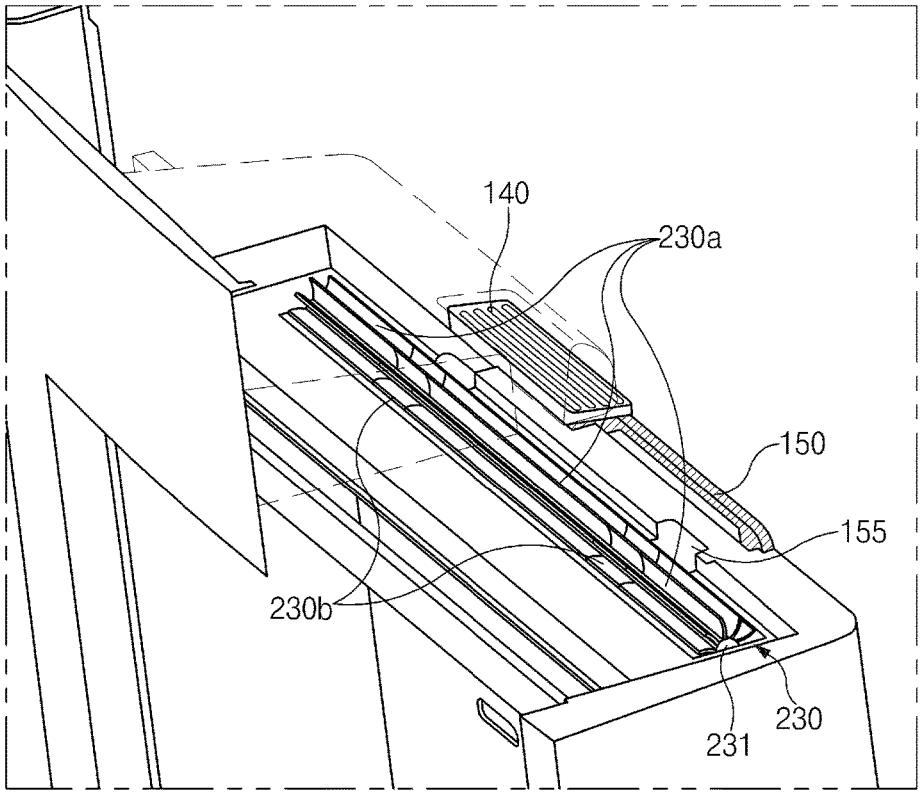
FIG. 3 illustrates the structure of a cooling fan according to various embodiments of the present disclosure.

FIG. 3 illustrates the structure of a cooling fan according to various embodiments of the present disclosure.

Referring to FIG. 3, the cooling fan 230 may include first fans 230*a* and second fans 230*b* alternately mounted on a single central shaft 231 in the longitudinal direction (a twin fan structure). For example, the first fans 230*a* may be disposed on opposite ends and the center of the central shaft 231, and the second fans 230*b* may be disposed between the first fans 230*a*. A processor (or controller) (not illustrated) of the refrigerator 101 may control an operation of the cooling fan 230 by using an electrical signal.

According to various embodiments, the first fans 230*a* and the second fans 230*b* may rotate simultaneously or separately. For example, the second fans 230*b* may be secured to the central shaft 231, and the first fans 230*a* may not be secured to the central shaft 231. The first fans 230*a* and the second fans 230*b* may be separated from or connected with one another through separate securing parts (not illustrated). In the case where the central shaft 231 rotates while the first fans 230*a* and the second fans 230*b* are connected together through the securing parts, the first fans 230*a* and the second fans 230*b* may rotate together. In contrast, in the case where the central shaft 231 rotates while the first fans 230*a* and the second fans 230*b* are separated from one another, the second fans 230*b* may rotate, whereas the first fans 230*a* may not rotate.

In an embodiment, the first fans 230*a* and the second fans 230*b* may simultaneously rotate in the case where direct cold air is introduced into the quick-chilling chamber 130 through the first cold-air inlet 140. The direct cold air may spread into the entire space inside the quick-chilling chamber 130 by the rotation of the first fans 230*a* and the second fans 230*b*. Additional information about the inflow of the direct cold air may be provided through FIG. 5.

In another embodiment, among the first fans 230*a* and the second fans 230*b*, only the second fans 230*b* may rotate in the case where indirect cold air is introduced into the quick-chilling chamber 130 through the second cold-air inlet 150. The second fans 230*b* may allow the indirect cold air to flow into the space inside the quick-chilling chamber 130 through the second flow passage 155. The indirect cold air supplied through the second flow passage 155 may be introduced through an opening inside the quick-chilling chamber 130. Additional information about the inflow of the indirect cold air may be provided through FIGS. 6 and 7.

Figure 4:
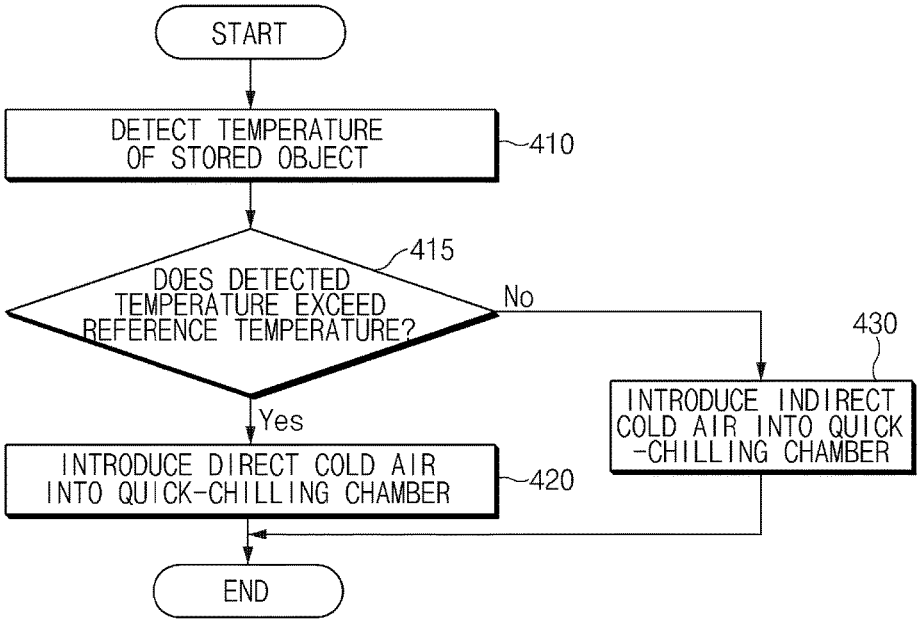
FIG. 4 is a flowchart illustrating a method for controlling direct cold air or indirect cold air according to various embodiments of the present disclosure.

FIG. 4 is a flowchart illustrating a method for controlling direct cold air or indirect cold air according to various embodiments of the present disclosure.

Referring to FIG. 4, in operation 410, the processor (or controller) (not illustrated) of the refrigerator 101 may detect the temperature of an object (e.g., food or drink) placed in the quick-chilling chamber 130. For example, the refrigerator 101 may include a sensor module (e.g., a temperature sensor) and may measure the temperature of objects stored in the racks 131 and 132, or may measure the temperature of the whole quick-chilling chamber 130, by using the sensor module.

In operation 415, the processor may determine whether the detected temperature of the object exceeds a reference temperature. In the case where the detected temperature of the object exceeds the reference temperature, the processor may, in operation 420, supply direct cold air into the quick-chilling chamber 130 through the first cold-air inlet 140. The processor may operate the compressor (not illustrated) to introduce direct cold air having a lower temperature than indirect cold air into the quick-chilling chamber 130 through the first flow passage 141, the first cold-air inlet 140, and the cooling fan 230.

In the case where the detected temperature of the object is lower than or equal to the reference temperature, the processor may, in operation 430, supply indirect cold air into the quick-chilling chamber 130 through the second cold-air inlet 150. The processor may introduce indirect cold air having a higher temperature than the direct cold air into the quick-chilling chamber 130 through the second cold-air inlet 150, the second fans 230*b* of the cooling fan 230, and the second flow passage 155.

According to various embodiments, in the case where the temperature of the stored object is within a reference temperature range, the processor may stop the supply of the cold air.

Figure 5:
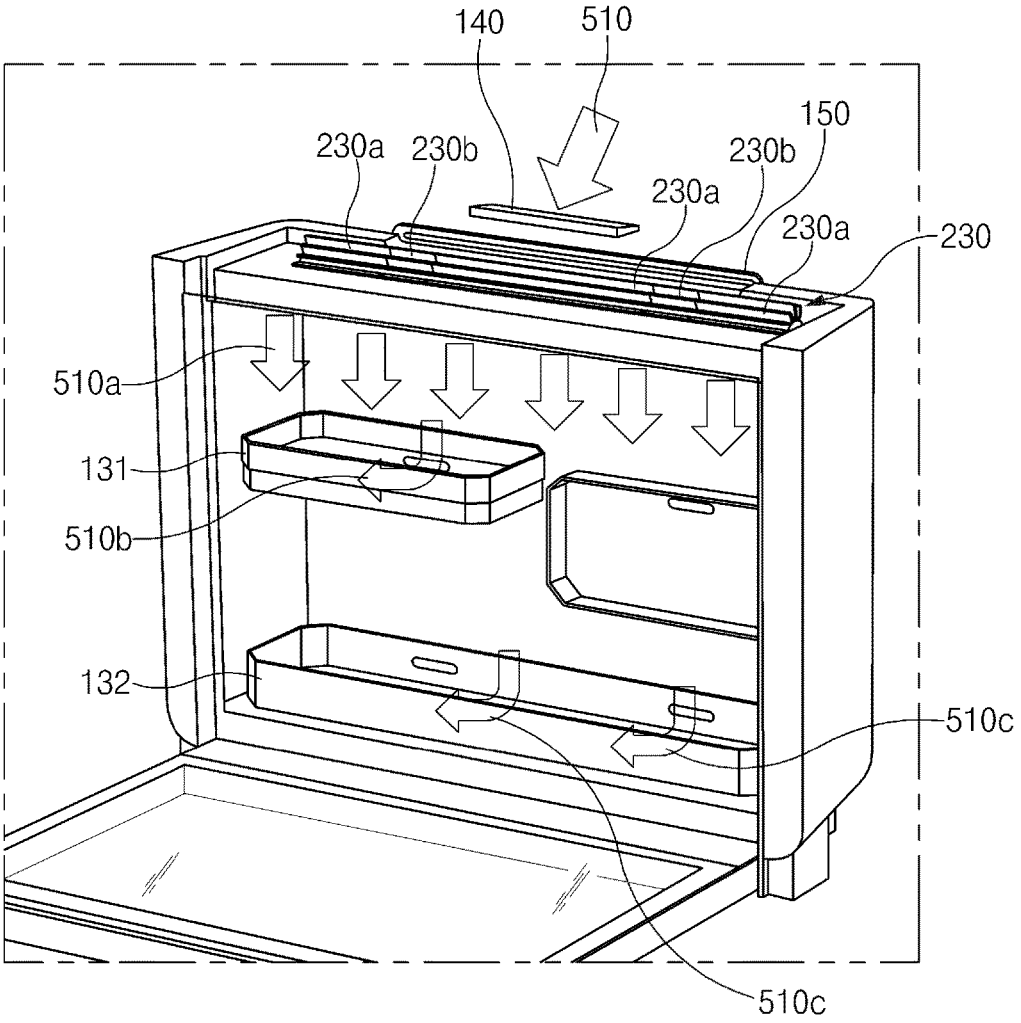
FIG. 5 illustrates a flow of direct cold air according to various embodiments of the present disclosure.

FIG. 5 illustrates a flow of direct cold air according to various embodiments of the present disclosure. FIG. 5 is merely illustrative, and the present disclosure is not limited thereto.

Referring to FIG. 5, direct cold air 510 may be introduced into the quick-chilling chamber 130 from the compressor (not illustrated) through the first cold-air inlet 140. The direct cold air 510 may have a lower temperature than indirect cold air supplied through the freezing compartment 110. Since the direct cold air 510 is relatively-low-temperature cold air directly supplied from the compressor, the temperature of a stored object, such as food or drink, may be rapidly lowered by the direct cold air 510.

According to various embodiments, in the case where the direct cold air 510 is introduced, the cooling fan 230 may be in a state in which the first fans 230*a* and the second fans 230*b* all rotate. The direct cold air 510 may pass through the cooling fan 230 and then disperse over the entire region of the quick-chilling chamber 130. The dispersed cold air 510*a*, 510*b*, and 510*c* may change the direction or turn along the racks 131 and 132 inside the quick-chilling chamber 130 to spread over the entire region of the quick-chilling chamber 130.

Figure 6:
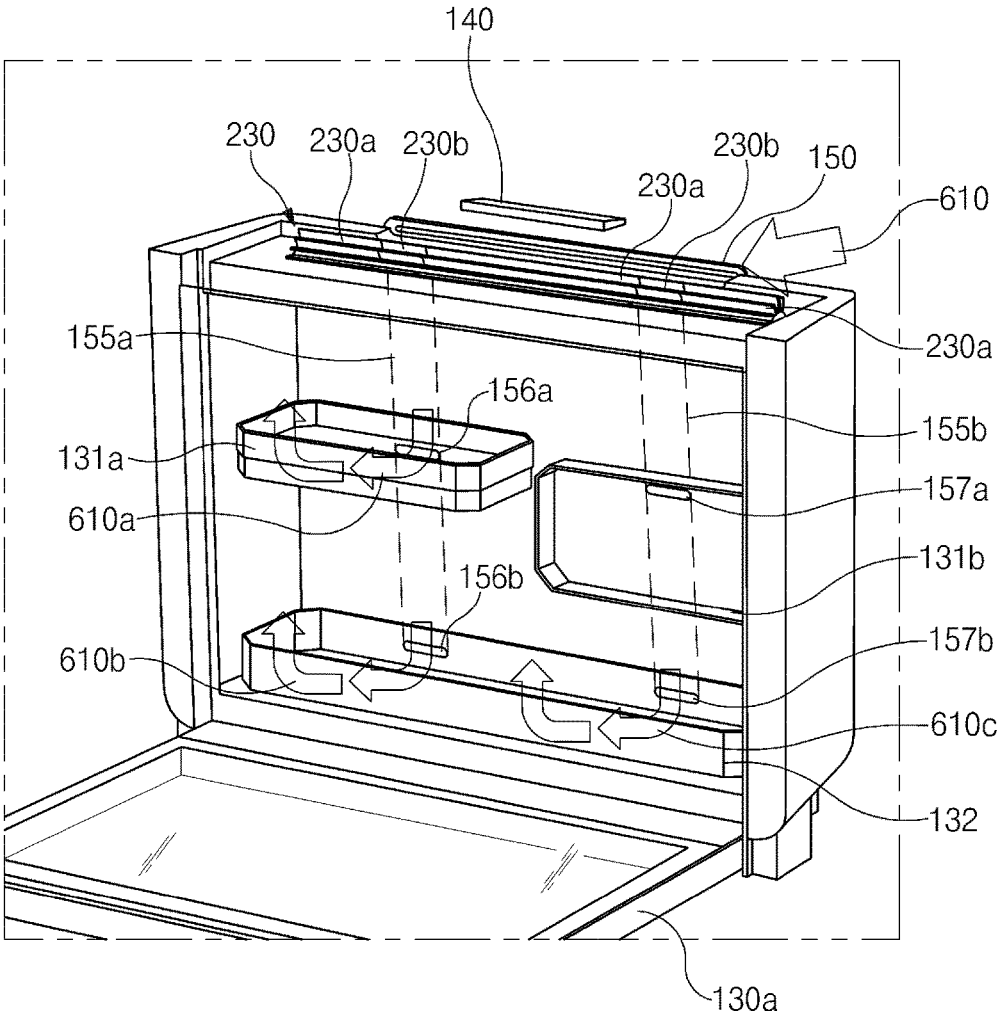
FIGS. 6 and 7 illustrate a flow of indirect cold air according to various embodiments of the present disclosure.
Figure 7:
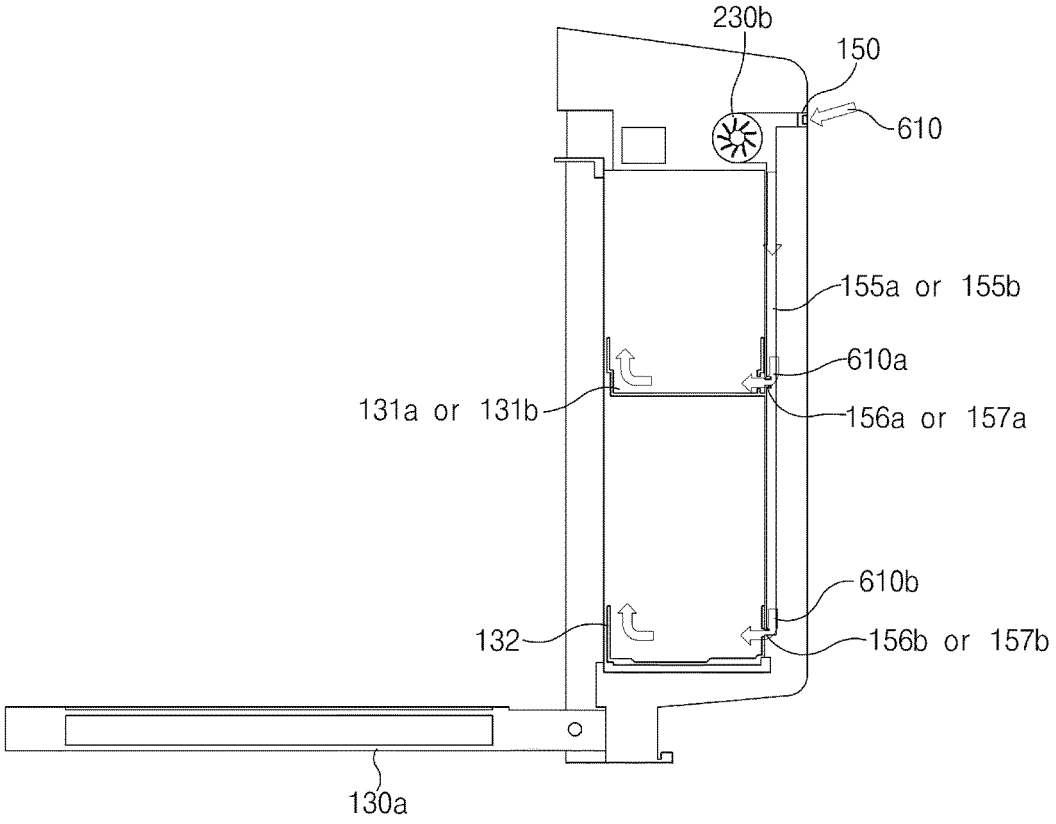

FIGS. 6 and 7 illustrate a flow of indirect cold air according to various embodiments of the present disclosure. FIGS. 6 and 7 are merely illustrative, and the present disclosure is not limited thereto.

Referring to FIGS. 6 and 7, indirect cold air 610 may be introduced into the quick-chilling chamber 130 from the freezing compartment 110 through the second cold-air inlet 150. The indirect cold air 610 may have a higher temperature than direct cold air supplied from the compressor (not illustrated). The indirect cold air 610 may be used to maintain the temperature of the quick-chilling chamber 130 within a specified temperature range.

According to various embodiments, in the case where the indirect cold air 610 is introduced, the cooling fan 230 may be in a state in which only the second fans 230*b*, among the first fans 230*a* and the second fans 230*b*, rotate. The second fans 230*b* may guide the indirect cold air 610 into the second flow passage 155*a* or 155*b* such that the indirect cold air 610 flows along the second flow passage 155*a* or 155*b*.

The indirect cold air 610 introduced along the second flow passage 155*a* or 155*b* may be discharged through a plurality of openings 156*a*, 156*b*, 157*a*, and 157*b* formed in an inner wall of the quick-chilling chamber 130. The plurality of openings 156*a*, 156*b*, 157*a*, and 157*b* may be located adjacent to the position where the rack 131*a*, 131*b*, or 132 is mounted. In the case where an object is stored in the rack 131*a*, 131*b*, or 132, the stored object may be chilled by the discharged indirect cold air 610*a*, 610*b*, and 610*c*.

According to various embodiments, the upper racks 131*a* and 131*b* may be unfolded parallel to the ground or may be folded to make contact with an inner surface of the quick-chilling chamber 130. For example, in the case where the upper rack 131*a* is unfolded, the indirect cold air 610*a* may be introduced through the opening 156*a*. The introduced indirect cold air 610*a* may spread along the bottom surface or side surfaces of the upper rack 131*a*.

According to various embodiments, the upper racks 131*a* and 131*b* may include holes formed in side surfaces in contact with the plurality of openings 156*a* and 157*a*, respectively. For example, in the case where the upper rack 131*a* is unfolded, the indirect cold air 610*a* introduced through the opening 156*a* may be delivered to the object placed on the upper rack 131*a* through the hole.

The discharged indirect cold air 610*a*, 610*b*, and 610*c* may change the direction or turn along the racks 131 and 132 inside the quick-chilling chamber 130 to spread over the entire region of the quick-chilling chamber 130.

Figure 8:
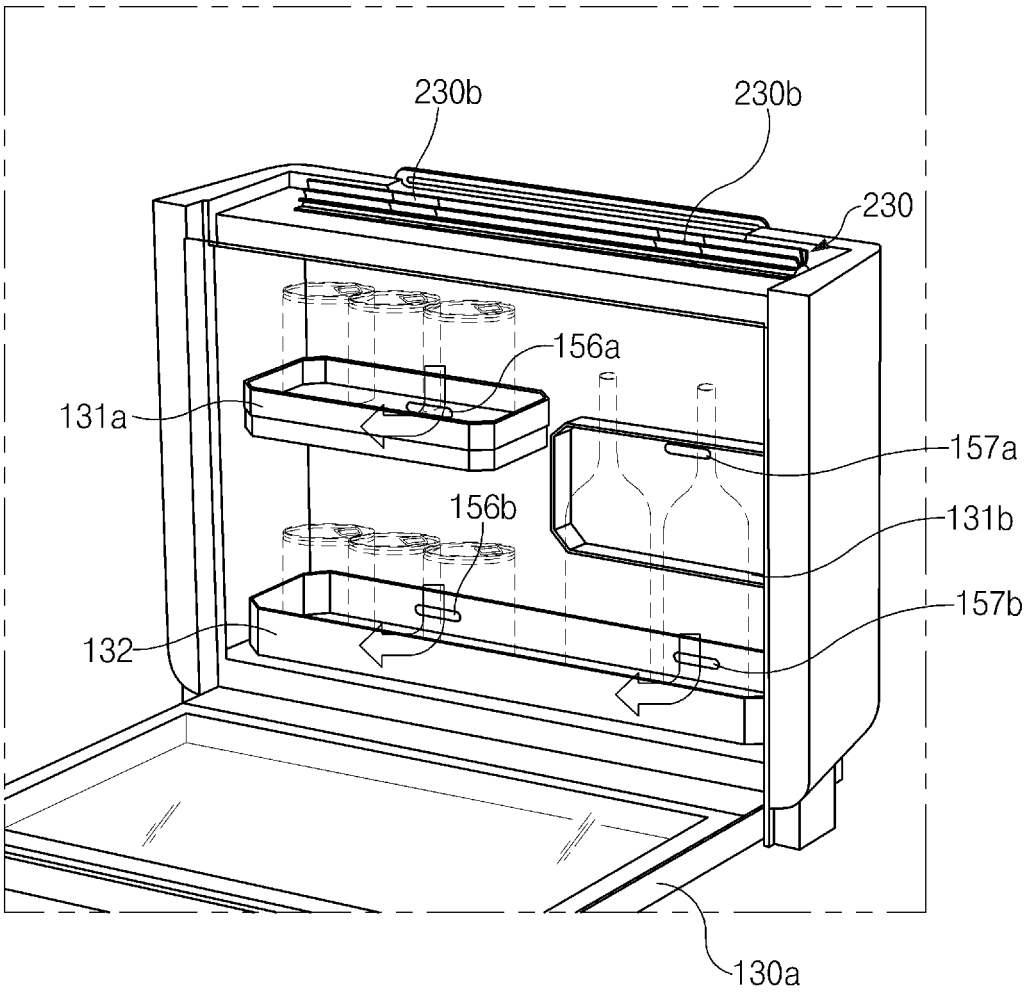
FIG. 8 illustrates objects placed on racks according to various embodiments of the present disclosure.

FIG. 8 illustrates objects placed on racks according to various embodiments of the present disclosure.

Referring to FIG. 8, the quick-chilling chamber 130 may include upper racks 131*a* and 131*b* and the lower rack 132 on which to place food or drink. A relatively small object (e.g., a beverage can) may be placed on the upper racks 131*a* and 131*b*, and in the case where the upper racks 131*a* and 131*b* are folded, a relatively long object (e.g., a wine bottle) may be placed on the lower rack 132.

According to various embodiments, in the case where the upper racks 131*a* and 131*b* are folded, the inflow of the indirect cold air 610 through the plurality of openings 156*a* and 157*a* may be blocked. The indirect cold air 610 may not be discharged through the blocked openings 156*a* and 157*a* but rather through the other openings. While FIG. 8 illustrates that the upper rack 131*b* is folded, the present disclosure is not limited thereto. For example, only the upper rack 131*a* may be folded, or the upper racks 131*a* and 131*b* may all be folded.

Figure 9B:
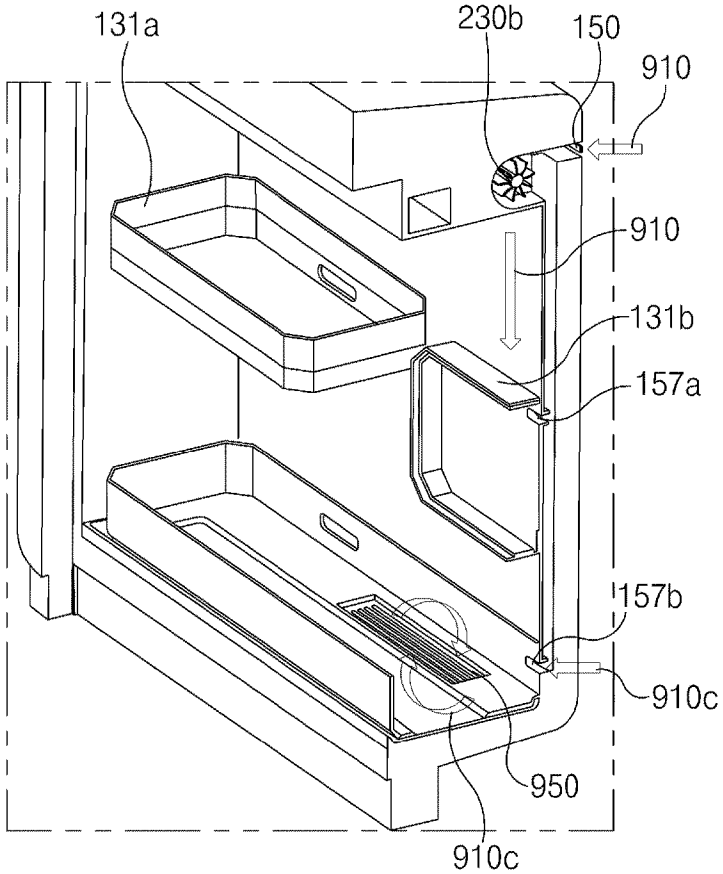
FIGS. 9A and 9B illustrate control of indirect cold air using upper racks according to various embodiments of the present disclosure.
Figure 9A:
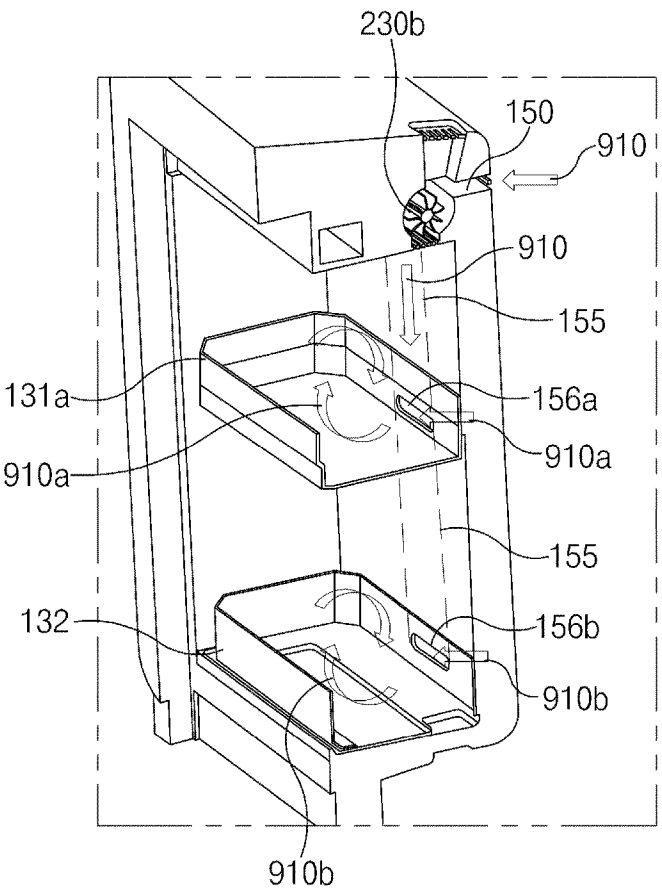

FIGS. 9A and 9B illustrate control of indirect cold air using upper racks according to various embodiments of the present disclosure.

Referring to FIG. 9A, the quick-chilling chamber 130 may include the upper racks 131*a* and 131*b* and the lower rack 132 on which to place food or drink. The upper racks 131*a* and 131*b* may be unfolded parallel to the ground or may be folded to make contact with an inner surface of the quick-chilling chamber 130.

In the case where the upper rack 131*a* is unfolded, the part 910*a* of the indirect cold air 910 may be introduced through the opening 156*a*. The introduced indirect cold air 910*a* may spread along the bottom surface or side surfaces of the upper rack 131*a*.

Part 910*b* of the indirect cold air 910 may be introduced into the lower rack 132 through the opening 156*b*. The introduced indirect cold air 910*b* may spread along the bottom surface or side surfaces of the lower rack 132.

Referring to FIG. 9B, in the case where the upper rack 131*b* is folded, the opening 157*a* may be blocked by the bottom surface of the upper rack 131*b*. In this case, the indirect cold air 910 may not be discharged through the opening 157*a*.

Part 910*c* of the indirect cold air 910 may be introduced into the lower rack 132 through the opening 157*b*. The introduced indirect cold air 910*c* may spread along the bottom surface or side surfaces of the lower rack 132. The introduced indirect cold air 910*c* may blow harder than the indirect cold air 910*b* discharged through the opening 156*b* in FIG. 9A.

Figure 10:
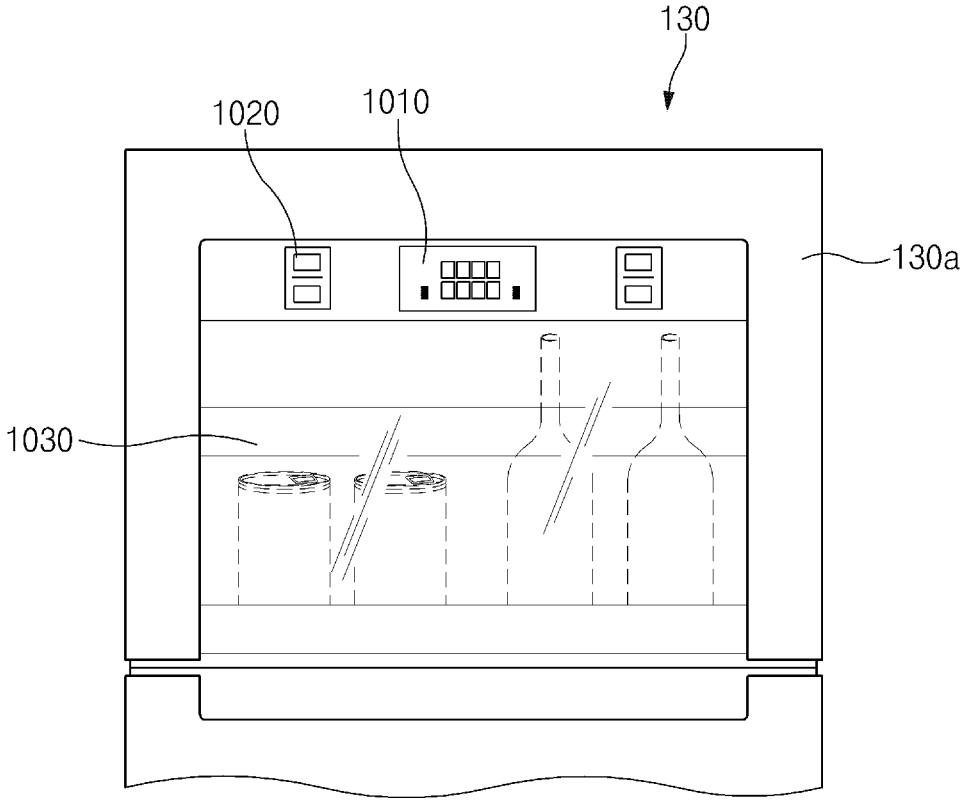
FIG. 10 illustrates a door of a quick-chilling chamber according to various embodiments of the present disclosure.

FIG. 10 illustrates a door of a quick-chilling chamber according to various embodiments of the present disclosure. FIG. 10 is merely illustrative, and the present disclosure is not limited thereto.

Referring FIG. 10, the quick-chilling chamber 130 may include the door 130*a* that is opened and closed in the up and down directions. According to various embodiments, the door 130*a* may include a display 1010, a button 1020, and a transparent window 1030.

The display 1010 may display states (e.g., operating or non-operating, temperature, and the like) of the quick-chilling chamber 130, or may display the current time.

The button 1020 may be implemented with a touch button or a physical button and may be used to change a state of the quick-chilling chamber 130 (e.g., a reference temperature).

The transparent window 1030 may be implemented with a material, such as reinforced glass. The transparent window 1030 may have a heating wire arranged therein to prevent condensation on the transparent window 1030. A user may check, through the transparent window 1030, a state in which food or drink is stored.

According to various embodiments, a refrigerator includes a freezing compartment, a refrigerating compartment, a quick-chilling chamber, and a compressor configured to supply cold air to at least one of the freezing compartment, the refrigerating compartment, or the quick-chilling chamber, wherein the quick-chilling chamber is cooled by first cold air introduced through the compressor or second cold air introduced through the freezing compartment.

According to various embodiments, the refrigerator further includes a cooling fan configured to spread the first cold air or the second cold air into the quick-chilling chamber, wherein the cooling fan includes a plurality of fans configured to rotate about a single shaft.

According to various embodiments, the plurality of fans include a first fan and a second fan configured to simultaneously or separately rotate about the single shaft. The first fan and the second fan simultaneously rotate in a state in which the first cold air is introduced into the quick-chilling chamber. The first fan is secured and the second fan rotates in a state in which the second cold air is introduced into the quick-chilling chamber.

According to various embodiments, the refrigerator further includes a sensor module configured to sense temperature, and a controller configured to control the quick-chilling chamber, wherein the controller is configured to direct the first cold air or the second cold air into the quick-chilling chamber based on information recognized through the sensor module.

According to various embodiments, the controller is configured to supply the first cold air into the quick-chilling chamber in response to a temperature of the quick-chilling chamber or a temperature of an object stored in the quick-chilling chamber being higher than or equal to a reference temperature.

According to various embodiments, the controller is configured to supply the second cold air into the quick-chilling chamber in in response to a temperature of the quick-chilling chamber or a temperature of an object stored in the quick-chilling chamber being lower than a reference temperature.

According to various embodiments, the quick-chilling chamber includes, in an inner wall, a plurality of openings through which the second cold air is introduced.

According to various embodiments, the quick-chilling chamber includes a rack mounted on the inner wall of the quick-chilling chamber so as to be folded or unfolded, and the plurality of openings are formed at positions adjacent to the rack.

According to various embodiments, the rack blocks the inflow of the second cold air through one of the plurality of openings in a state in which the rack is folded.

According to various embodiments, the rack includes a hole formed in a side surface in contact with one of the plurality of openings.

According to various embodiments, the quick-chilling chamber includes a cold-air inlet connected with the refrigerating compartment.

According to various embodiments, the quick-chilling chamber is formed in a door of the freezing compartment or in a door of the refrigerating compartment.

According to various embodiments, the quick-chilling chamber includes a door apparatus, and the door apparatus is opened in a second direction in a state in which the door of the freezing compartment or the door of the refrigerating compartment is opened in a first direction. The first direction is perpendicular to the second direction.

According to various embodiments, the door apparatus includes a display, and at least one of a physical button or a touch button configured to control the quick-chilling chamber.

According to various embodiments, the door apparatus is implemented to be transparent by using reinforced glass and includes a heating wire inside.

According to various embodiments, the freezing compartment is disposed on an upper or lower side of the refrigerating compartment.

According to various embodiments, the freezing compartment is disposed on a left or right side of the refrigerating compartment.

According to various embodiments, a refrigerator includes a freezing compartment, a quick-chilling chamber, and a compressor configured to supply cold air to at least one of the freezing compartment or the quick-chilling chamber, wherein the quick-chilling chamber is cooled by first cold air introduced through the compressor or second cold air introduced through the freezing compartment.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A refrigerator comprising:

a freezing compartment;

a refrigerating compartment;

a quick-chilling chamber;

a compressor of a cooling circulation system for cooling air supplied to at least one of the freezing compartment, the refrigerating compartment, or the quick-chilling chamber;

a sensor module configured to sense a temperature of the quick-chilling chamber; and a controller configured to control the temperature of the quick-chilling chamber, wherein the quick-chilling chamber is cooled by at least one of first cold air cooled by a refrigerant of the compressor or second cold air introduced through the freezing compartment, wherein, when the temperature sensed by the sensor module exceeds a reference temperature, the controller is configured to control a cooling fan to direct the first cold air into the quick-chilling chamber, and wherein, when the temperature is lower than to the reference temperature, the controller is configured to control the cooling fan to direct the second cold air into the quick-chilling chamber.

2. The refrigerator of claim 1, wherein the cooling fan includes a plurality of fans configured to rotate about a single shaft.

3. The refrigerator of claim 2, wherein the plurality of fans includes a first fan and a second fan for simultaneously or separately rotating about the single shaft.

4. The refrigerator of claim 1, wherein the quick-chilling chamber includes, in an inner wall, a plurality of openings through which the second cold air is introduced.

5. The refrigerator of claim 4, wherein the quick-chilling chamber includes a rack mounted on the inner wall of the quick-chilling chamber so as to be folded or unfolded, and wherein the plurality of openings are formed at positions adjacent to the rack.

6. The refrigerator of claim 5, wherein the rack blocks the inflow of the second cold air through at least one of the plurality of openings in a state in which the rack is folded.

7. The refrigerator of claim 5, wherein the rack includes a hole formed in a side surface in contact with one of the plurality of openings.

8. The refrigerator of claim 1, wherein the quick-chilling chamber includes a cold-air inlet connected with the refrigerating compartment.

9. The refrigerator of claim 1, wherein the quick-chilling chamber is formed in a door of the freezing compartment or in a door of the refrigerating compartment.

10. The refrigerator of claim 9, wherein the quick-chilling chamber includes a door apparatus, and wherein the door apparatus is opened in a second direction in a state in which the door of the freezing compartment or the door of the refrigerating compartment is opened in a first direction.

11. The refrigerator of claim 10, wherein the first direction is perpendicular to the second direction.

12. The refrigerator of claim 10, wherein the door apparatus includes:

a display; and at least one of a physical button or a touch button for controlling temperature in the quick-chilling chamber.

13. The refrigerator of claim 10, wherein the door apparatus is implemented to be transparent by using reinforced glass and includes a heating wire inside.

14. The refrigerator of claim 1, wherein the freezing compartment is disposed on an upper or lower side of the refrigerating compartment.

15. The refrigerator of claim 1, wherein the freezing compartment is disposed on a left or right side of the refrigerating compartment.

16. A refrigerator comprising:

a freezing compartment;

a refrigerating compartment;

a quick-chilling chamber;

a compressor of a cooling circulation system for cooling air supplied to at least one of the freezing compartment, the refrigerating compartment, or the quick-chilling chamber; and a cooling fan including a plurality of fans configured to rotate about a single shaft, wherein the quick-chilling chamber is cooled by first cold air cooled by a refrigerant of the compressor or second cold air introduced through the freezing compartment, wherein the cooling fan is configured to spread the first cold air or the second cold air, wherein the plurality of fans includes a first fan and a second fan configured to simultaneously or separately rotate about the single shaft, wherein the first fan and the second fan simultaneously rotate in a state in which the first cold air is introduced into the quick-chilling chamber, and wherein the first fan is secured and the second fan rotates in a state in which the second cold air is introduced into the quick-chilling chamber.

17. A refrigerator comprising:

a freezing compartment;

a quick-chilling chamber;

a compressor of a cooling circulation system for cooling air supplied to at least one of the freezing compartment, or the quick-chilling chamber;

a sensor module configured to sense a temperature associated with of the quick-chilling chamber; and a controller configured to control the temperature of the quick-chilling chamber, wherein the quick-chilling chamber is cooled by at least one of first cold air cooled by a refrigerant of the compressor or second cold air introduced through the freezing compartment, wherein, when the temperature sensed by the sensor module exceeds a reference temperature, the controller is configured to control a fan to direct the first cold air into the quick-chilling chamber, and wherein, when the temperature is lower than to the reference temperature, the controller is configured to control the fan to direct the second cold air into the quick-chilling chamber.

* * * * *